United States Patent [19]

Slater

[11] 3,947,024

[45] Mar. 30, 1976

[54] TIRETOYS

[75] Inventor: Gerald E. Slater, Milwaukee, Wis.

[73] Assignee: Newtoys, Inc., Milwaukee, Wis.

[22] Filed: Mar. 12, 1974

[21] Appl. No.: 450,327

[52] U.S. Cl. ..... 272/60 R; 427/221
[51] Int. Cl.[2] ..... A63B 9/00; B44C 1/08
[58] Field of Search ..... D34/5 H; 272/60 R, 57 R; 114/219; 293/1, 71 P; 161/48, 184, 239; 85/7; 40/125 M; 117/139

[56] References Cited

UNITED STATES PATENTS

| | | | |
|---|---|---|---|
| 2,562,957 | 8/1951 | Sipkin et al. | 114/219 |
| 2,956,806 | 10/1960 | Routson | 272/60 R |
| 3,623,900 | 11/1971 | Jonnes et al. | 117/139 |
| 3,664,653 | 5/1972 | Walker | 114/219 |
| 3,764,446 | 10/1973 | Martin | 293/1 |

OTHER PUBLICATIONS

Bruins, *Epoxy Resin Technology*, 1968, Copyright, Wiley Interscience Pub., Chapter 14, Authored by Shackelford.

*Primary Examiner*—Richard C. Pinkham
*Assistant Examiner*—Harry G. Strappello
*Attorney, Agent, or Firm*—John C. Cooper, III

[57] ABSTRACT

Children's playground toys constructed from used tires are coated with an epoxy resin coating which is resistant to abrasion, temperature fluctuations and which adheres firmly during flexing and stretching of the tires during use. The coating enhances the visual appearance and functional characteristics of the equipment and prevents rub-off from the tire bodies onto the skin or clothing of children using the playground toys.

4 Claims, 4 Drawing Figures

TIRETOYS

BACKGROUND OF THE INVENTION

The invention relates generally to the art of children's playground equipment, particularly climbing toys, constructed from discarded tire bodies. It has been known for a number of years that entertaining children's toys and play equipment can be constructed from tires, the most familiar example of which is the "tire swing" found in innumerable backyards and playgrounds across the country.

In very recent years new kinds of tire toys have been developed which are safe and durable and which, most importantly, are fun for children and which encourage creative play. Such toys are constructed from tire bodies attached together to form relatively large climbing structures, towers, etc. In some cases pipes may join together several individual "units" to allow more children to play on the equipment in high density play areas like churches, schools, day-care centers, etc. Additionally, bouncing toys, functioning like trampolines, can be prepared by joining two or more tires together and providing a platform on which a child can stand or sit. Examples of such equipment will be described in detail in the following description of the present invention.

Even though these recently developed toys functioned adequately, several disadvantages were encountered. First, old tire bodies are often discolored and grey-black in appearance. Accordingly, the visual attractiveness of such equipment was low in comparison to the shinier lacquered steel and plastic playground equipment. This disadvantage is not offset from the average purchaser's standpoint by the fact that steel and plastic equipment is considerably more expensive to buy. In addition, the rubber from old tires tends to rub off on the clothing and skin of children. In an attempt to overcome these disadvantages, various coatings have been applied to the tire bodies to improve the visual appearance and prevent rub-off, but until the present invention no suitable coatings were known to the art.

Initial coating applications of materials, such as "Rubbertone," manufactured by DuPont, did temporarily improve the visual appearance, but the coating itself could rub off onto clothing or skin and it was not durable or shiny. Other coatings did not have satisfactory adhesion qualities and would tend to flake off the tire bodies during use. This latter problem is especially pronounced in cold temperature climates where many resin coatings become brittle, and the problem is compounded because the tire toys are constantly flexed, twisted or otherwise distorted during use.

SUMMARY OF THE INVENTION

It is a primary object of the present invention to provide resin-coated children's playground equipment constructed from tire bodies, which equipment overcomes the foregoing disadvantages.

It is another object of the present invention to provide children's playground equipment constructed from tire bodies, which equipment is attractive in visual appearance and which does not dirty children's skin or clothing during use.

Another object of the present invention is to provide children's playground equipment constructed from tire bodies which are coated with a resin coating which resists abrasion and which adheres tightly to the tire carcasses during use.

How these and other objects of the present invention are accomplished will be described in detail in the following description of the preferred embodiment of the present invention taken in conjunction with the drawings. Generally, however, the invention comprises constructing the playground equipment in any suitable manner, such as by gluing, riveting or bolting tires together in the desired configuration. The completed equipment is then coated with an epoxy resin and the coating is allowed to dry. The coating adheres firmly to the tire body even under conditions of stress of the tire body over wide temperature ranges. Also the coating improves the visual appearance of the tire body and it is not easily removed by children even after extended use. The surface of the coating additionally possesses desirable friction characteristics, providing a sufficiently slip-free surface, but not being so resistive to sliding movement that "burns" on the skin are encountered.

DESCRIPTION OF A PREFERRED EMBODIMENT

Figure 1:
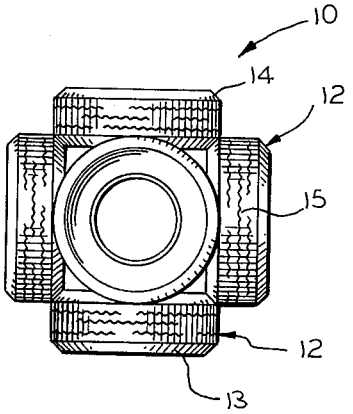
FIG. 1 is an elevation view of one preferred coated children's playground unit according to the present invention.

FIG. 1 shows the basic unit 10 for children's playground toys which is suitable for use as is or in combination with other units in a manner to be described in detail in connection with FIGS. 2 and 3. Unit 10 consists of six tires 12 suitably joined together in the shape of a cube. Connection between individual tires can be made in any suitable manner such as by adhesives, but it has been found preferable to bolt the tires together. Mating holes are drilled through the tire carcasses and a bolt (not shown) is inserted through the holes. A washer and lock nut then complete the bonding process. Because children will often reach into the annular ring inside the sidewalls, it would be preferable that the bolt only be long enough to extend a small distance into that annular ring so that the lock nut will substantially cover the exposed threads and prevent knicks and cuts to users of the equipment. It is also preferred to drill the holes for bolt insertion through the shoulder areas 14 of the tires rather than through either the tread 15 or sidewall 13 portions of the tires 12. The angulated shoulders of most tires provide an ideal mating surface for the "cube" equipment depicted in FIG. 1.

The particular types of tires to be employed in constructing playground equipment according to the present invention can vary widely. For instance, standard size automobile tires are ideal for small playgrounds and one to three children can play on cube 10 at one time. Cubes 10, so constructed, are even small enough that they can be readily moved indoors in winter months if desired. Larger tires provide additional adventure for children and many more children can play on a cube 10 constructed from large truck tires. The invention is, therefore, not to be limited as to the size of the tires, and the invention can readily be adapted to the size, use and space requirements of the play area.

Figure 2:
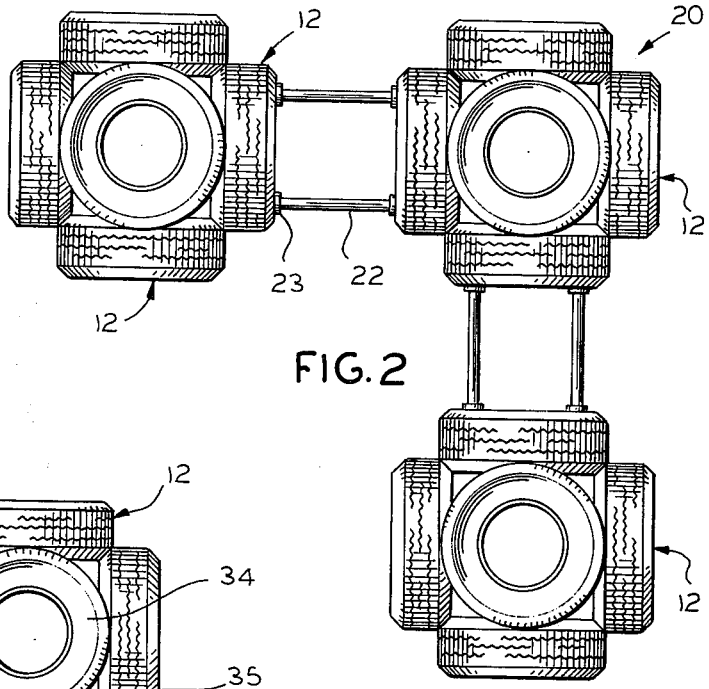
FIG. 2 is a top view of a second embodiment of a coated children's playground toy according to the present invention including three of the "units" of FIG. 1.

FIG. 2 shows a triple cube unit 20 constructed from three units 10 as described in FIG. 1. The individual cubes 10 are identical to those previously described, but are connected together by pipes 22 to form a highly stable playground toy including additional climbing surfaces not found in cube 10 alone. In the preferred embodiment of the triple cube unit 20, four pipes 22 are secured between adjacent vertical tires 12 through sidewall portions 13 of adjacent tires. Again, a bolt is inserted through holes in the sidewalls after the pipe 22 and washers 23 are in place. A lock nut and retaining washer are added inside the tires in the manner described above in connection with cube 10. Any number of pipes may be employed as long as sufficient pipes are provided to insure the structural integrity of the overall unit. Alternate embodiments of FIG. 2 would include varying numbers of cubes 10, e.g., 2 to any higher number of units 10. The individual units 10 could be arranged linearly, in an L-shape, in the shape of a cross, etc.

Figure 3:
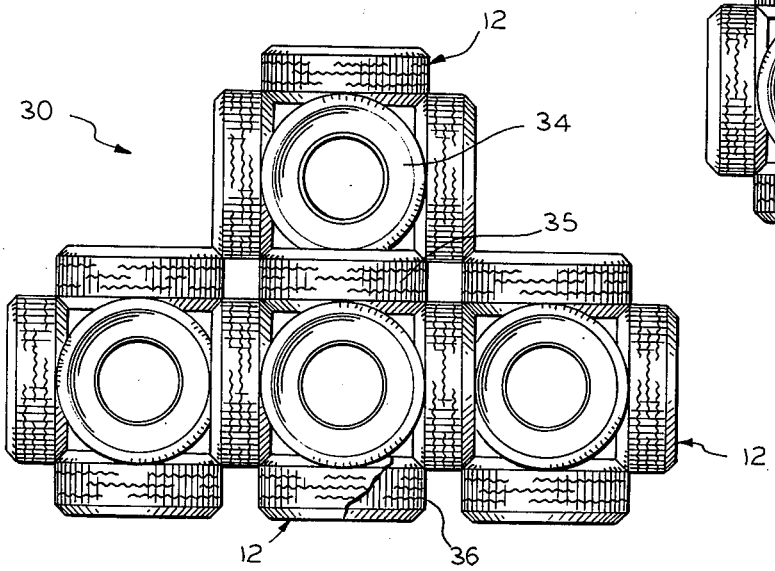
FIG. 3 is a side view of a third embodiment of a coated children's playground toy according to the present invention including additional units as shown in FIG. 1.

FIG. 3 illustrates another playground toy 30 constructed from cubes 10 but not employing pipes 22 (although pipes could be employed as hereinbefore described if desired). Five cubes 10 are arranged with four cubes 10 at ground level and an "attic" 34 affixed centrally to the ground level cubes. The ground level cubes are arranged in a cross-shape with a central cube being formed by the four vertical inside tires of the ground level cubes, the bottom tire 35 of the attic cube 34 and a central bottom tire 36 vertically below tire 35. Each of the 31 tires comprising toy 30 are bonded to appropriate ones of the other tires in the manner hereinbefore described in connection with individual cube 10 of FIG. 1.

Figure 4:
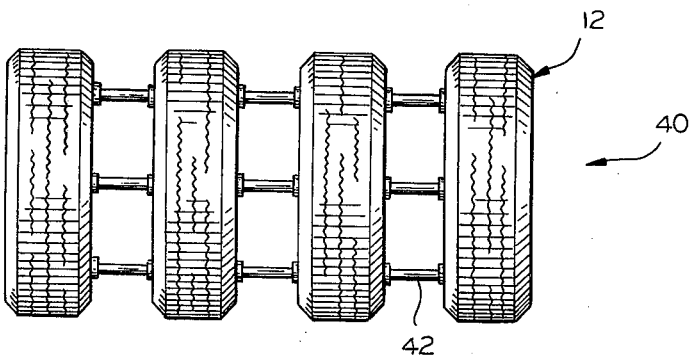
FIG. 4 is a side view of an alternate embodiment of the present invention showing coated tire playground equipment connected by pipes to form a tire tunnel.

FIG. 4 illustrates a still further type of playground toy which can be coated in accordance with the present invention. Tunnel 40 is constructed of four tires 12 which are connected to each other by six pipes 42 in a manner similar to that employed for the tri-cube 20 of FIG. 2. As previously discussed in connection with FIG. 2, the number of pipes 42 and the number of tires 12 can be varied according to need.

The foregoing description illustrates several preferred embodiments of the toys which are useful in accordance with the present invention, but any other configuration of tires may be employed. For example, a single tire "swing" can be advantageously coated according to the process to be described shortly, to overcome the aforementioned problems.

Before or after the tire playground equipment has been constructed, the coating of the present invention is applied to the individual tires 12 in any suitable manner such as by brushing, spraying, dipping, etc. In some instances, it is only necessary to coat the sidewall, shoulder and tread areas as these are the only areas normally contacted during children's play. If, however, larger tires are used, it is preferred to coat the inner portions of the tire since children can sit, crawl or stand in the large donut-shaped spaces in these kinds of tires.

The preferred coating composition of the present invention is Anchor White Cap Primer No. 2460 available from Anchor Coating Co. of Waukesha, Wis. This particular material has a total resins solids content of approximately 21 percent, a drying time of approximately 12 hours at room temperature and a useful service temperature range of from −70° F to 250° F. While the particular solvent-coating system has been designed as a primer coating for wood, metal and concrete substrates, the present invention extends the usefulness of the coating to rubber tire substrates. Primer No. 2460 dries to a semigloss finish which creates the appearance of new rubber on the old carcasses, but the finish is much shinier than that of new tires. Also, as previously discussed, the characteristics of the finish are optimum from a safety standpoint since the dried coating provides a satisfactory non-slip finish while it is not so slip-proof that burns or scrapes are encountered. The flexibility of the coating and the adherence to the tire bodies are also optimum even under extreme temperature variations such as those encountered in the northern states. Even at temperatures in the area of 0°F, the coating remained firmly affixed to the tires as the tires were stretched, compressed and otherwise distorted during testing.

Specifically, Anchor White Cap Primer No. 2460 is prepared by mixing in equal proportions an epichlorohydrin-bisphenol epoxy resin and a polyamide curing agent derived from a dimerized fatty acid and an aliphatic amine. The solvents for the epoxy resin fraction are xylene, methyl ethyl ketone and heptane, while the curing agent is dissolved in xylene, methyl isobutyl ketone, methyl ethyl ketone and heptane. The exact composition of Primer No. 2460 is not known to the present inventors, other than as described in this paragraph, but the epoxy resin and curing agent are commercially available from the aforesaid source.

A final finishing step may be acccomplished by painting the sidewalls of tires 12 with a bright color coating, e.g., a pigmented primer such as employed for coating the remainder of the tire or an entirely different coating.

Among other coating compositions tried by the present inventors before the discovery of the beneficial properties of Primer No. 2460 were "Rubbertone" and various latex coatings such as Pittsburg Paint Company's vinyl latex paint and DeGraco's Pararock Chlorinated Rubber Enamel and Vinyl Primer sold by Cook Paint and Varnish Company. None of these coatings provided the proper combination of desirable properties.

While the present invention has been described in connection with several particular configurations of tire playground equipment, the invention is not to be limited to those embodiments but is to be limited solely by the claims which follow.

I claim:

1. Children's playground equipment comprising:

at least two tire cubes each comprising six cubically arranged tire bodies, the four vertical bodies of which are connected to the two horizontal tire bodies through adjacent shoulder portions thereof and said tire cubes being spaced apart from each other so that adjacent vertical tire bodies of the respective tire cubes are substantially coaxial, fastening means interconnecting said spaced apart adjacent vertical tire bodies, said fastening means comprising a plurality of horizontal pipe means interconnecting said adjacent vertical tires through the sidewall portions thereof, and a substantially uniform coating of a cured epoxy resin on at least the exterior surfaces of said tire bodies, said coating having been applied as a 50/50 mixture of an epichlorohydrin-bisphenol epoxy resin and a polyamide curing agent which is the reaction product of a dimerized fatty acid and an aliphatic amine.

2. The invention set forth in claim 1 wherein said playground equipment includes more than two of said tire cubes and said cubes are arranged linearly.

3. The invention set forth in claim 1 wherein said playground equipment includes more than two of said tire cubes and wherein at least one of said tire cubes has adjoining vertical tire bodies interconnected to adjacent tire cubes.

4. Children's playground equipment comprising:

at least two spaced apart, substantially coaxial tire bodies, fastening means interconnecting said spaced apart tire bodies, said fastening means comprising a plurality of pipe means interconnecting adjacent ones of said tire bodies through the sidewall portions thereof, and a substantially uniform coating of a cured epoxy resin on at least the exterior surfaces of said tire bodies, said coating having been applied as a 50/50 mixture of an epichlorohydrin-bisphenol epoxy resin and a polyamide curing agent which is the reaction product of a dimerized fatty acid and an aliphatic amine.

* * * * *